United States Patent [19]

Montemarano

[11] 4,333,583

[45] Jun. 8, 1982

[54] DRINKING SPOUT COVER

[76] Inventor: Joseph Montemarano, Angie Dr., Hopewell Junction, N.Y. 12533

[21] Appl. No.: 145,848

[22] Filed: May 1, 1980

[51] Int. Cl.[3] ..... B65D 41/32

[52] U.S. Cl. ..... 220/90.4

[58] Field of Search ..... 220/90.2, 90.4, 367, 220/368, 373, 266; 229/7 R, 7 S; 222/541; 215/253, 256

[56] References Cited

U.S. PATENT DOCUMENTS

| | | | |
|---|---|---|---|
| D. 233,972 | 12/1974 | juhlin | 220/90.4 X |
| 2,550,568 | 4/1951 | Kersh | 220/90.2 X |
| 2,772,802 | 12/1956 | Woydatt | 215/256 |
| 3,025,988 | 3/1962 | Williams | 215/253 |
| 3,171,580 | 3/1965 | Davis | 220/90.2 X |
| 3,557,995 | 1/1971 | Mirasol | 220/367 X |
| 3,805,991 | 4/1974 | Cheladze | 220/373 |
| 4,187,954 | 2/1980 | Striggow | 220/90.4 |
| 4,243,156 | 1/1981 | Lobbestael | 220/90.4 X |

*Primary Examiner*—Donald F. Norton

*Attorney, Agent, or Firm*—Spellman, Joel & Pelton

[57] ABSTRACT

A drinking spout cover for a liquid container comprises a plastic cover or lid having a peripheral edge which protrudes downwardly and is designed to engage the lip on a container and an upwardly protruding liquid spout at the edge portion of the cover. The drinking spout cover includes a hollow shaped portion extending upwardly from the cover and having a separate spout affixed thereto along a perforated edge. A small thumb tab may also be provided on the spout cover so that it may be readily pulled backwardly tearing the cover along the perforations to expose the spout opening for drinking purposes. The cover facilitates drinking from a container with a minimum of spillage particularly when the consumer is moving or in an automobile.

5 Claims, 4 Drawing Figures

FIG. 1
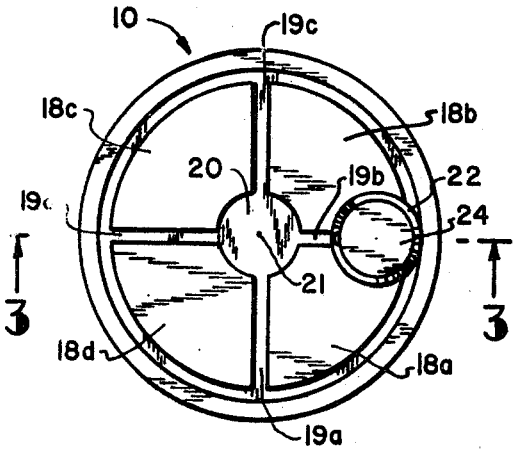
FIG. 2
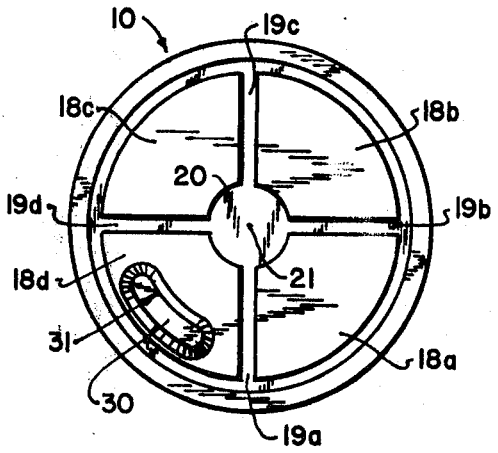
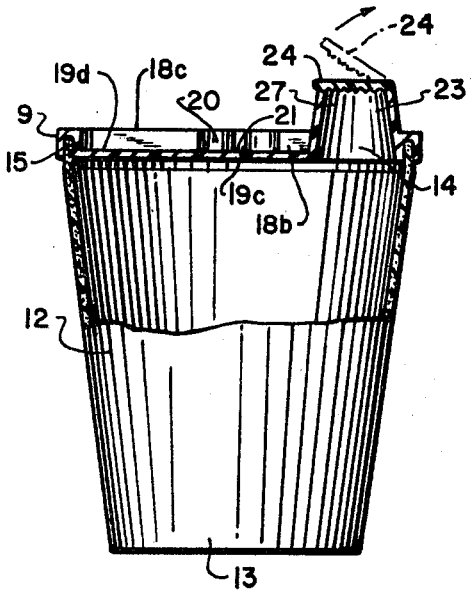
FIG. 3
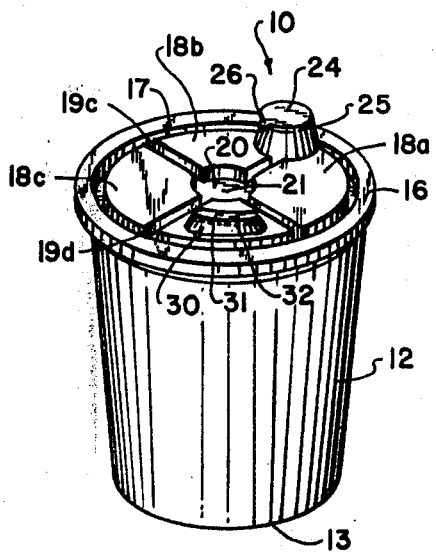
FIG. 4

DRINKING SPOUT COVER

BACKGROUND OF THE INVENTION

This invention relates to covers for drinking containers and in particular to a new and improved cover which facilitates drinking with a minimum of spillage under varying conditions of use.

The prior art disclosed in a patent search includes U.S. Pat. No. 3,524,566 to K. J. Parks, which discloses a straw slot for a container closure. A scored horizontal wall is located in a raised straw slot location and designed to be pivoted out of the way by insertion of a straw.

U.S. Pat. No. 3,977,559 to Lombardi discloses a lid which includes a flip-open section which is perforated along the edges thereof and hinged at approximately the center of the lid so that the sector may be flipped opened and closed periodically as desired. A tab is provided on the cover to assist in opening the flip-open section but no spout is disclosed.

U.S. Pat. No. 3,197,089 to Michael discloses a separate drinking spout which is used in conjunction with a typical can. Rather than the unitary arrangement disclosed herein, the Michael patent is concerned with a permanently mounted can cover having an opening to which a spout may be mounted.

Of marginal interest is U.S. Pat. No. 2,550,568 to Kersh which discloses a protruding spout on a device for weaning infants. The spout comprises in essence a conical projection on the lid extending outwardly from one edge of the cover. Also in the same general area as the present invention are U.S. Pat. No. 2,608,841 to W. W. Rice and U.S. Pat. No. 2,309,385 to P. N. Fleming, neither of which is particularly pertinent to the present disclosure.

Finally, U.S. Pat. No. 3,858,767 to Borin discloses a container for storing and dispensing liquids including a spout extending outwardly from the side wall of the cup with the upper edge of the spout in the plane of the upper edge of the cup.

In summary, none of the above patents discloses the particular drinking spout cover of applicant's invention. More specifically, applicant has a unique spout arrangement with a perforated cover having a thumb tab which may be pulled back to permit fluid flow or the spout itself may be squeezed to facilitate lifting of the cover on the spout. Applicant's invention is useful since it permits drinking from the cup or the container with the possibility of minimum spillage even if the consumer is moving or in an automobile. Furthermore, the spout cover may be replaced for intermittent use.

SUMMARY OF THE INVENTION

The present invention relates to a new type of cover for drinking containers and particularly to a new and improved cover including a drinking spout having a perforated cover thereon. Means such as a thumb tab on the cover may be provided-for removing the spout cover. The spout may be frustoconical or shaped to conform to a user's mouth. Since the lid is always maintained in position the contents of the container will remain hot or cold for a longer period of time due to less exposure with the environment. Furthermore, there is less chance of spillage with the spout than with an open container.

Accordingly, an object of this invention is to provide a new improved cover for drinking containers including a spout having a perforated cover thereon.

A further object to this invention is to provide a new improved drinking spout cover wherein the container includes a spout having a perforated cover thereon which may be readily removed for use.

A still further object to this invention is to provide a new and improved drinking spout cover which includes a spout of a particular configuration which includes a perforated upper cover which may be opened readily by squeezing the walls of the spout.

BRIEF DESCRIPTION OF THE DRAWINGS

Other objects and advantages to the present invention may be seen from the following description review in conjunction with the accompanying drawings wherein:

FIG. 1 is a top view of the cover comprising one embodiment of the present invention.

FIG. 2 is a top view of a second embodiment of the invention;

FIG. 3 is a cutaway side view of a container taken along the line 3—3 of FIG. 1 including the cover with portions cut away to illustrate the structure of the invention; and FIG. 4 is a perspective view of the container with the cover in place on the container and the embodiments of FIG. 1 and 2 combined.

DETAILED DESCRIPTION OF THE INVENTION

Referring now to the drawings, the invention comprises a new and improved drinking spout cover 10 which is adapted to fit over and enclose a container 11. The container 11 may be a typical paper or plastic container for beverages with a frusto-conical wall portion (FIGS. 1 and 4), a base 13 and an upper aperture 14. The upper edge of the wall portion 12 comprises a circumferential lip 15 extending about the opening 14.

The cover 10 comprises a downwardly extending peripheral portion 9 joined to an outer raised portion 16 which extends circumferentially about the container 11. The raised portion 16 extends inwardly for a predetermined distance to engage the upper portion of the lip 15. The portion 16 is connected to a downwardly extending sloped portion 17 which leads to the main surface 18 of the lid 10. The main body portion 18 is divided into separate segments **18*a*, 18*b*, 18*c* and 18*d* by recesses 19*a*, 19*b*, 19*c* and 19*d*, respectively, which lead to a center portion 20 which is recessed and includes a central aperture 21 to permit the outflow of air when the lid is closed about a container 11**.

The lid 10 includes towards one edge thereof, a raised drinking spout 22 which includes an upwardly extending wall portion 23 and an upper cover 24. The spout 22, in one embodiment, is positioned along the recessed portion **19*b* at the end of the lid 10. The cover 24 includes a perforated edge 25 which may be ripped backwardly to expose the aperture 27 for drinking purposes. A small outwardly extending thumb tab 26 may also be included on the cover 24 to aid in ripping back the cover along the perforations 25. An adhesive backing may also be provided on the thumb tab 26 so that the cover 24 may be secured back in place for intermittent drinking with the adhesive contacting the wall portions 23. In an alternate embodiment, no thumb tab is provided and the user merely squeezes the wall portion 23 to force the cover 24 free from the perforations 25**.

Also shown in the embodiments of FIGS. 2 and 4 is a curved drinking spout 30 which may or may not be provided together with the frustoconical drinking spout 22 as in FIG. 4 or may be provided separately as in FIG. 2. The curved spout 30 includes an upper perforated cover 31 and curved wall portions 32 which extend thereabout so that the spout 30 readily fits into the users mouth. The spout 30 is positioned in between recessed portions 19*c* and 19*d*.

The invention as thus disclosed above comprises an economical, easily manufactured lid 10 which can be readily fitted on a container 11 by the resilient periperal portion 9 and will serve to keep the contents cold or hot while preventing spillage. The recessed portions 19*a*, 19*b*, 19*c* and 19*d* also add a degree of flexibility to the cover 10. The lid 10 is advantageous for use by children where the likelihood of spillage may be greater. Furthermore, the spout 23 permits rapid drinking from the cup or container 11 since a separate airhole is provided in the lid 10.

It is to be understood that the above-described arrangements are merely illustrative examples of the application. Numerous other arrangements may be readily devised by those skilled in the art which will embody the principles of the invention and fall within the spirit and scope thereof.

What is claimed is:

1. A drinking spout cover for a liquid container having a substantially circular opening comprising:

a substantially circular main body portion of a plastic material having a slightly greater diameter than the container opening and a flexible and downwardly extending peripheral portion said body portion further including a central recessed portion of a cylindrical configuration extending downwardly from the main body portion and having a central aperture in the base thereof, said aperture permitting an outflow of air during closure of the cover on a container and a plurality of evenly spaced recessed channels, the majority of said channels extending from the central recessed portion towards the periphery of the cover, and a drinking spout positioned on the main body portion towards the periphery of the cover and in line with one of said recessed channels, said spout comprising an upwardly extending hollow frustoconical member having an unobstructed interior, a cover integrally mounted across the upper end of the spout and having a tab extending outwardly therefrom for gripping purposes and said spout having a plurality of fine perforations circumferentially arranged about the upper surface thereof to permit ready removal of the cover for drinking purposes.

2. A drinking spout cover in accordance with claim 1 wherein:

the cover further includes a raised portion extending upwardly from the plane of the main body portion about the circumference and forming a recess with the downwardly extending peripheral portion to engage the edge of the container, the raised portion having an inner diameter substantially the same as the diameter of the container and wherein, the recessed channels are four in number and located at ninety degree intervals from each adjacent recess.

3. A drinking spout cover in accordance with claim 2 wherein:

the tab normally extends inwardly towards the center of the container and includes an adhesive backing so that the cover may be repositioned with the adhesive gripping the outer walls of the spout.

4. A drinking spout cover in accordance with claim 1 wherein:

the spout is flexible and extends upwardly from the main body portion within the periphery of the main body portion for a sufficient distance to permit gripping by the fingers such that the spout cover, secured by fine perforations to the frustoconically shaped walls, may be forced free by squeezing the walls of the spout.

5. A drinking spout cover in accordance with claim 1 wherein:

the main body portion includes a second spout extending upwardly therefrom and having a curved elongated configuration designed to fit the user's mouth and a removable cover mounted thereover by a scored section along the upper wall of the spout.

* * * * *